US006698572B2

(12) United States Patent
Loewenthal et al.

(10) Patent No.: US 6,698,572 B2
(45) Date of Patent: Mar. 2, 2004

(54) APPARATUS AND PROCESS FOR PACKAGING PIECE GOODS

(75) Inventors: Horst Loewenthal, Waldshut-Tiengen (DE); Harald Lenherr, Beringen (CH)

(73) Assignee: SIG Pack Systems AG, Beringen (CH)

( * ) Notice: Subject to any disclaimer, the term of this patent is extended or adjusted under 35 U.S.C. 154(b) by 0 days.

(21) Appl. No.: 10/232,097

(22) Filed: Aug. 30, 2002

(65) Prior Publication Data

US 2003/0051438 A1 Mar. 20, 2003

(30) Foreign Application Priority Data

Sep. 17, 2001 (CH) ..... 1708/01
Feb. 27, 2002 (CH) ..... 0345/02

(51) Int. Cl.[7] ..... B65G 47/26; B65B 21/06; B65B 35/30; B65B 35/50

(52) U.S. Cl. ..... 198/426; 198/434; 53/443; 53/447

(58) Field of Search ..... 198/426, 434; 53/443, 445, 447, 450

(56) References Cited

U.S. PATENT DOCUMENTS 5,390,475 A * 2/1995 Iwauchi et al. ..... 53/474
6,148,589 A * 11/2000 Fukui et al. ..... 53/442
6,321,509 B1 * 11/2001 DelDuca et al. ..... 53/400

FOREIGN PATENT DOCUMENTS

| | | |
|---|---|---|
| CH | 400 892 | 10/1965 |
| EP | 1 006 051 | 6/2000 |
| GB | 766 462 | 1/1957 |
| GB | 1 001 036 | 5/1963 |
| GB | 1 444 640 | 12/1973 |
| GB | 1 444 640 | 8/1976 |

* cited by examiner

*Primary Examiner*—Gene O. Crawford
(74) *Attorney, Agent, or Firm*—Harness, Dickey & Pierce, P.L.C.

(57) ABSTRACT

In an apparatus for packaging piece goods, a piece-goods article of a first type (A) and a plurality of piece goods of a second type (B) are introduced into a common pack. The apparatus has a first conveyor (1), for feeding piece goods of the first type (A), a second conveyor (3), for feeding piece goods of a second type (B), and a packing station (7), for forming a flexible tube (72). It also has at least one feed station (2), from which the piece goods of the second type (B) are deposited by means of the second conveyor (3) such that the piece goods of the second type (B) are located one above the other at least in part and form first groups. In each case one of these first groups is deposited on a piece-goods article of the first type (A) from the second conveyor (3) by conveying means (4, 10), this resulting in the formation of a second group, which is introduced into the flexible tube (72). Force-applying means (5, 6) are provided here in order that the second group maintains its shape as it is introduced into the flexible tube (72). The apparatus makes it possible for non-stackable piece goods of different types to be transported together and packaged together in a tubular bag. In particular it is possible for flat masses of noodles, together with bags of sauce and spices located thereon, to be packaged in tubular bags.

18 Claims, 6 Drawing Sheets

APPARATUS AND PROCESS FOR PACKAGING PIECE GOODS

TECHNICAL FIELD

The invention relates to an apparatus and a process for packaging piece goods.

PRIOR ART

GB-A-1,444,640 describes an apparatus for packaging biscuits which are stacked one above the other. The biscuits are positioned as a stack on a board sleeve. The board sleeve and the biscuits are pushed forward in the conveying direction by means of a carry-along element, the board being folded in a folding station and being introduced into a flexible tube in a following tubular-bag station. The flexible tube is then subdivided into tubular bags in a welding and cutting unit.

It is sometimes desirable, however, for different types of piece goods to be packaged, in a state in which they are located one above the other, in a common tubular bag. For example, there are, in particular, Asiatic noodle dishes in the case of which dried noodles and sauces or spices packaged in small bags are packaged in a common bag. The noodles here are present in the form of a flat mass and do not have any further packaging. A preferred packaging method is one in which the bags are introduced into the tubular bag in a state in which they rest on the flat noodle mass. In this case, the tubular bag is of such narrow design that the piece goods located one above the other are kept in position. The difficulty with this packaging method is that, on account of their shape and on account of the non-planar bearing surface of the flat noodle masses, the bags tend to slip down from this flat noodle mass during transportation to the tubular-bag station. In addition, the transportation becomes less stable as the number of bags positioned on the flat mass increases.

SUMMARY OF THE INVENTION

It is thus an object of the invention to provide an apparatus and a process for packaging piece goods by means of which it is possible, in a straightforward and efficient manner, for different piece goods to be introduced reliably, in a state in which they are located one above the other, into a common pack. It is an object of the invention, in particular, to provide an apparatus and a process by means of which it is possible to package the above described noodle dishes.

According to the invention, piece goods of a first type are fed on a first conveyor and piece goods of a second type are arranged, via feed stations, by means of a second conveyor such that the piece goods of the second type are already located one above the other in layers and form groups. The groups of piece goods of the second type are then positioned on the piece goods of the first type. During introduction into the tubular bag, force is applied in order that the grouping maintains its shape. The conveying means includes a stationary surface and first carry along elements. The stationary surface is arranged above the first conveyor and the carry along elements can be moved along this surface in the direction of the first conveyor.

This makes it possible for different types of piece goods which cannot actually be stacked to be arranged reliably one above the other, to be transported reliably in a state in which they are located one above the other, and to be packaged reliably, in this position, in a horizontal tubular-bag machine. The reliable guidance throughout makes it possible for the process to be carried out at high speeds, with the result that the apparatus may have a throughput of up to 400 bags per minute.

The apparatus according to the invention is suitable, in particular, for piece goods of the first type of essentially cubic or flat-cylindrical shape and for piece goods of the second type in the form of flat bags. Even if the piece goods of the first and second types do not have any completely planar bearing surface, and the piece goods of the second type additionally tend to slip down, the apparatus according to the invention allows them to be grouped together and packaged together. In particular it is possible for two or more bags to be positioned on a flat noodle mass and for these to be packaged together in a horizontal tubular-bag machine.

It is advantageous, furthermore, that the apparatus according to the invention can be used for different combinations of piece goods. In addition, it can easily be adapted to different sizes of piece goods.

In a straightforward embodiment, the conveying means is merely formed by carry-along elements and the piece goods of the second type are positioned directly on the piece-goods article of the first type by the second conveyor. A preferred embodiment, however, provides a stationary surface, a so-called dead plate, along which the piece goods of the second type, in layered groups, are pushed before they are deposited on the piece goods of the first type. This makes it possible to select as desired the distance between the point at which the groups are formed and the point at which packaging in the tubular bags takes place.

In a further preferred embodiment, a second conveyor is arranged beneath each feed station, the second conveyor having a downwardly directed abutment surface for conveying the piece goods of the second type.

Further advantageous embodiments may be gathered from the dependent patent claims.

BRIEF DESCRIPTION OF THE DRAWING

The subject matter of the invention is explained herein below with reference to preferred exemplary embodiments which are illustrated in the attached drawing, in which.

METHOD OF IMPLEMENTING THE INVENTION

Figure 1:
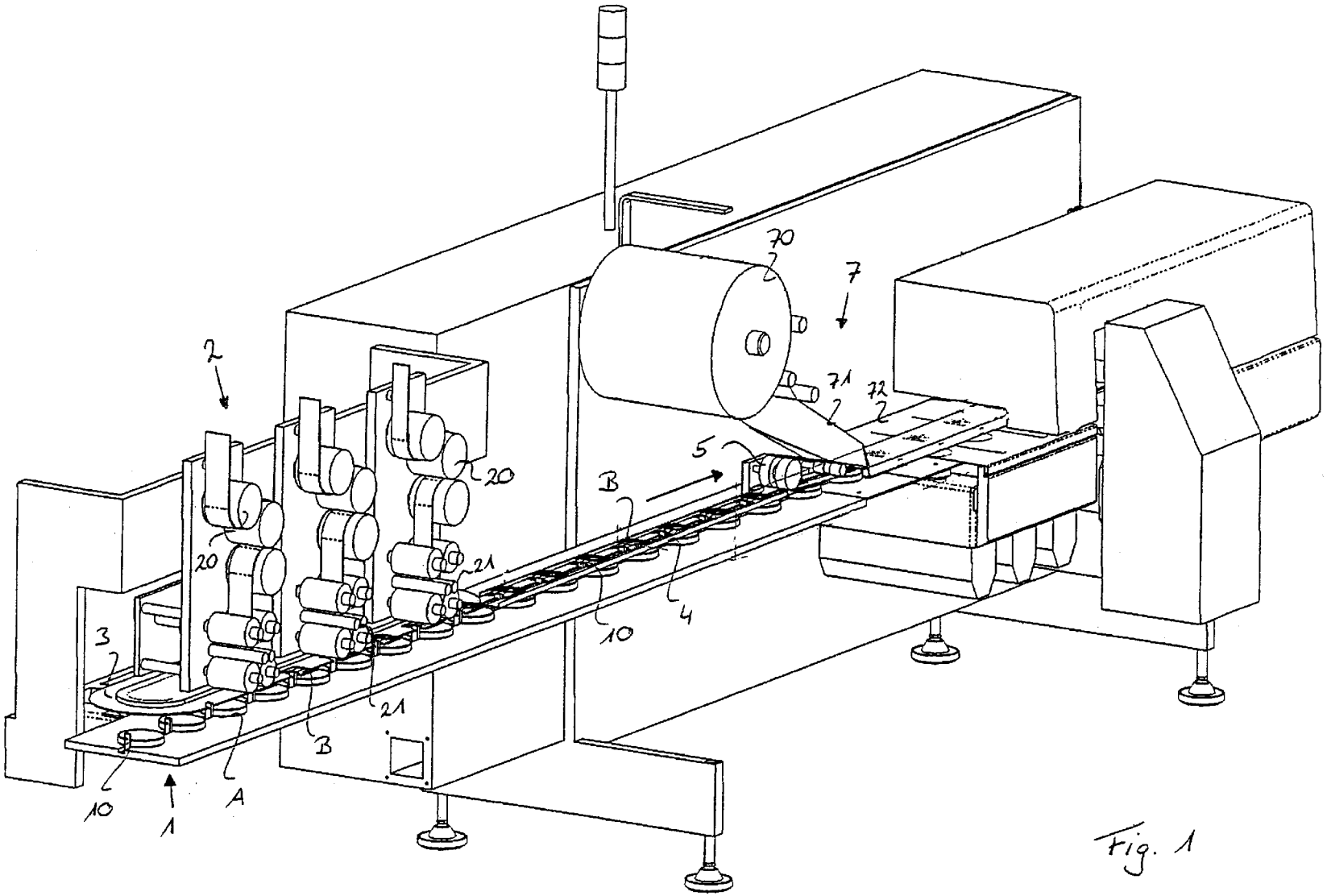
FIG. 1 shows a perspective illustration of a first embodiment of an apparatus according to the invention.

A first embodiment of the apparatus according to the invention, as is illustrated in FIG. 1, has a first conveyor 1, for feeding piece goods of a first type A. These piece goods A preferably each have an at least more or less planar bearing surface, which is directed upward. In this example, these piece goods are the flat noodle masses mentioned in the introduction. The first conveyor 1 is designed as a circulating chain conveyor. It has carry-along elements 10 by means of which the piece goods of the first type A are pushed forward cyclically in a first, horizontal conveying direction until they pass into a packaging station 7, which will be described at a later stage in the text. The first conveying direction is illustrated by an arrow in FIG. 1.

In a plane which is perpendicular to the first conveying direction, and thus vertical, at least one feed station 2 is, in this case three feed stations 2 are, arranged above the first conveyor 1. The feed stations may also be arranged at an angle. The feed stations 2 serve for feeding the piece goods of the second type B. These piece goods of the second type B are fed in the form of strips of bags which are attached to one another. For this purpose, the feed stations 2 have suitable deflecting rollers 20 and corresponding severing means 21, in particular cutting devices with rotating cutters. Such feed stations 2 are sufficiently known in the prior art and are thus not described in detail here.

The piece goods of the second type may be, but do not have to be, of identical design. They may, as has been described above, comprise bags. It is also possible, however, for at least some of the piece goods of the second type B to be in some other form. Thus, they may be, for example, cooking instructions printed on paper, loose ingredients or cutlery.

A second conveyor 3 is arranged beneath the feed stations 2, but laterally above the first conveyor 1. In the exemplary embodiment described here, said second conveyor is formed by a conveying belt circulating in a horizontal plane. In this case, a sub-region of the second conveyor 3 runs at least more or less parallel to the first conveying direction. The bags severed in the individual feed stations 2 are positioned on said sub-region. These bags, which then form the piece goods of the second type B, are positioned on the second conveyor 3 here such that they are located one above the other at least in part, that is to say they are layered one above the other. As a result, they form first groups. This can be achieved in different ways. In the example illustrated here, a first bag is positioned on the second conveyor 3 by the first feed station 2, as seen in the conveying direction. From the following feed station 2, a bag likewise passes onto the second conveyor 3, said bag ending up offset slightly forward, as seen in the conveying direction, on the first bag. This is repeated in the third feed station. This shingle-like layered formation has the advantage that the bags are displaced least, and the pile is maintained, as they are transported further. It is also possible, however, for the bags to be positioned one above the other such that they are offset rearward. Furthermore, it is possible to use a single feed station and to activate the latter such that a plurality of bags end up located one above the other in layered groups.

The bags layered one above the other are carried along by the second conveyor 3, conveying means being provided in order for said bags to be positioned on the piece goods of the first type A from the second conveyor 3. This takes place, in the example illustrated here, by means of the carry-along elements 10. The bags are arranged on the second conveyor 3 here such that they overlap the latter slightly at the side. The carry-along elements 10 run, with the first conveyor 1, along the second conveyor 3 and each push a group of the bags B over a piece-goods article of the first type A in each case. It is preferable, however, for the groups, rather than then being deposited directly on the piece goods of the first type A, to pass on to a slotted dead plate 4, which is arranged above the first conveyor 1. The carry-along elements 10 project through the slot 40 in the dead plate 4 and push the groups of bags, together with the associated flat noodle masses, further in the conveying direction.

The resulting second groups, comprising the already grouped-together piece goods of the second type B and in each case one piece-goods article of the first type A, pass into the region of the horizontal tubular-bag packaging station 7. This packaging station 7 is also sufficiently known in the prior art and is thus not explained in detail here. It is essentially the case that a sheet material 71 supplied by a reel 70 is transported in the conveying direction of the first conveyor 1 and bent into a flexible tube 72, the second groups of piece goods are introduced, and the flexible tube 72 is welded to form individual tubular bags, and the latter are severed.

The carry-along element 10 is then lowered from this station. The dead plate 4 terminates simultaneously, with the result that the layered bags drop onto the flat noodle mass. In order that the bags are not displaced here, a force-applying means is provided according to the invention. The means ensures that the second groups maintain their shape, that is to say their layered formation, until they have been fully introduced into the flexible tube.

Figure 2:
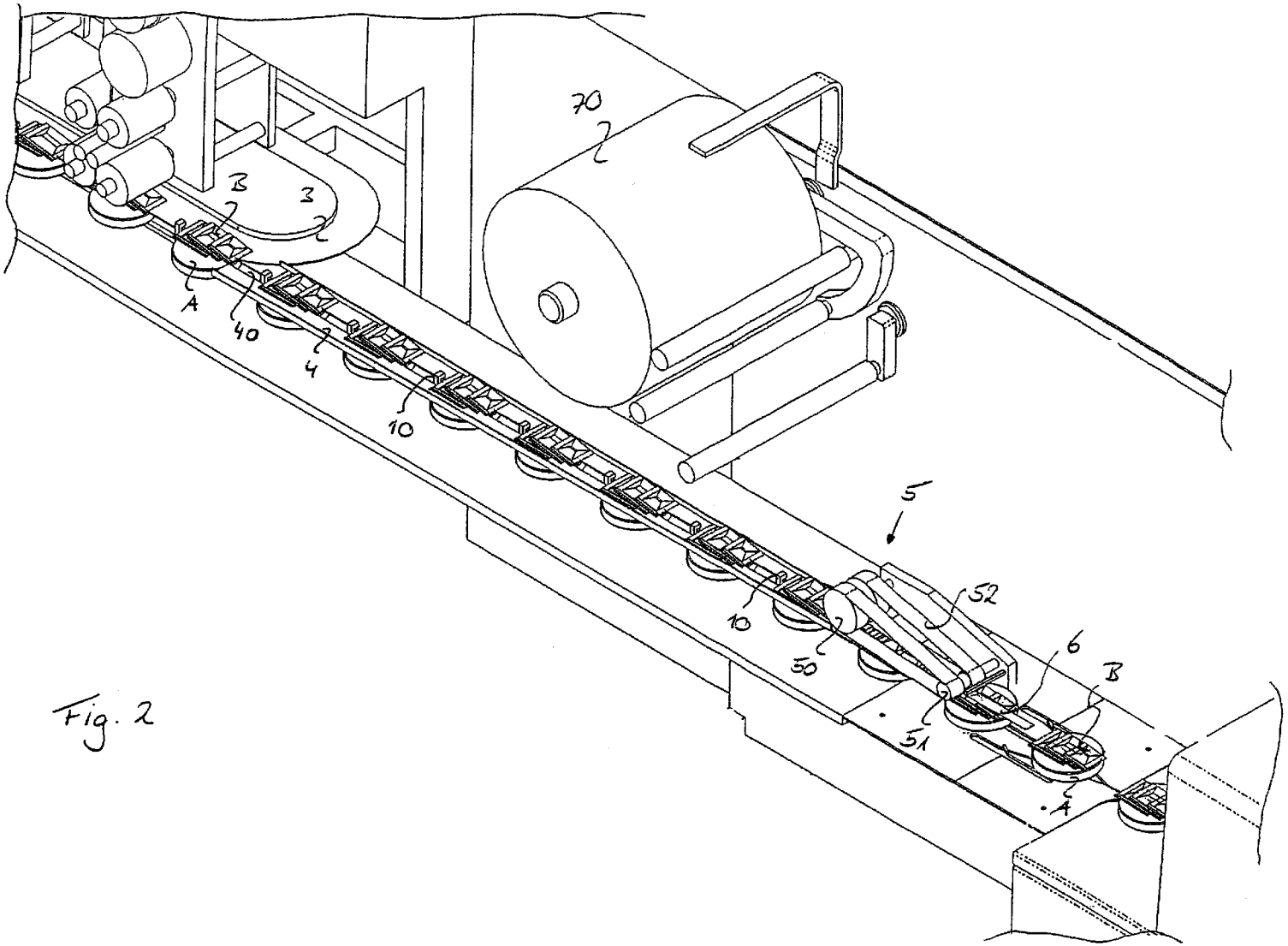
FIG. 2 shows an enlarged detail of FIG. 1, albeit without packaging sheet material.
Figure 3:
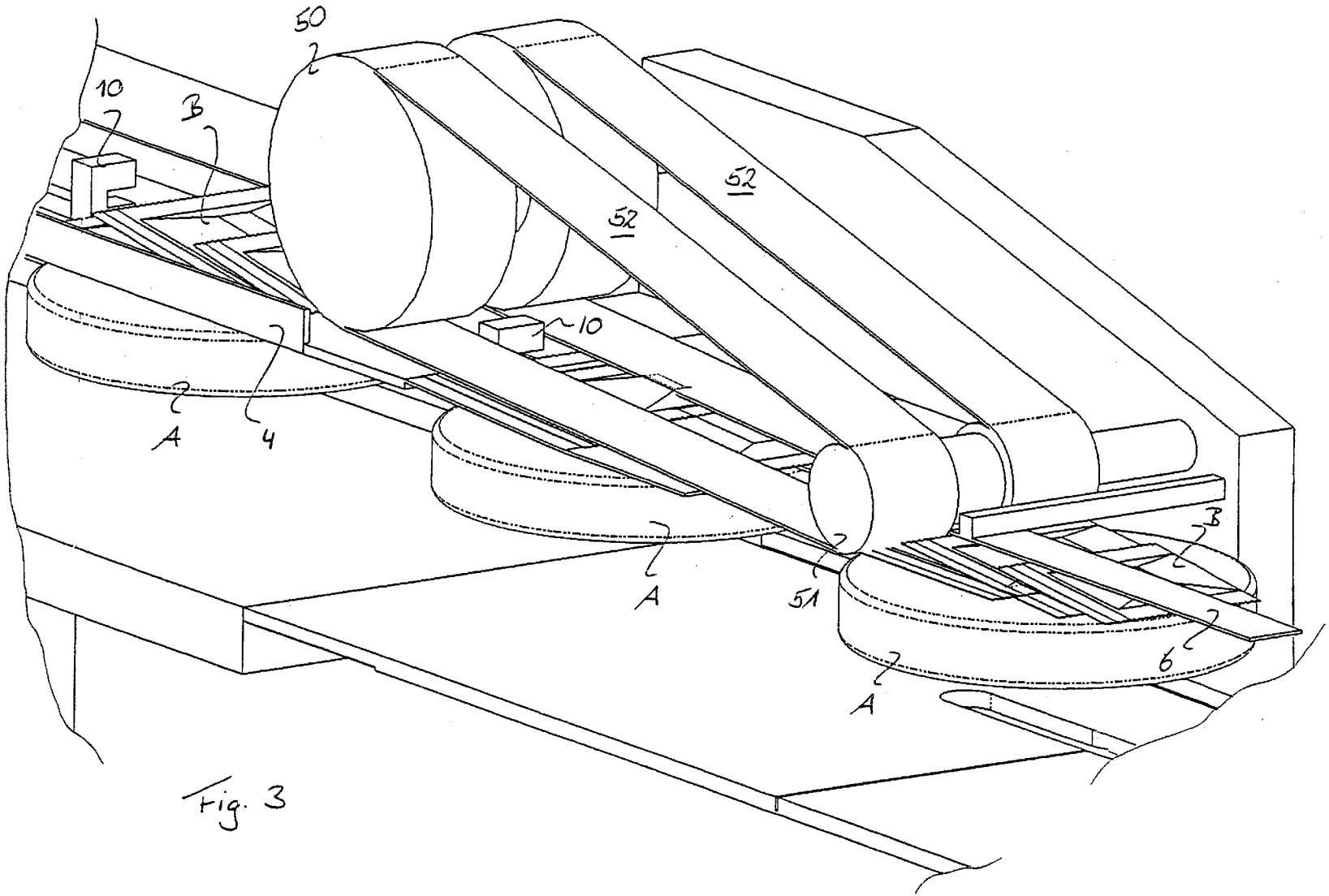
FIG. 3 shows an enlarged detail of FIG. 2.

This means can be seen clearly in FIGS. 2 and 3. It comprises a belt conveyor 5 with at least one vertically circulating belt 52, in this case two vertically circulating belts 52, which rest on the second groups. The belt conveyor preferably has resiliently mounted deflecting rollers 50, 51, with the result that the belt 52 presses onto the second groups by its spring force and thus maintains the shape of the latter. The front roller 51, as seen in the conveying direction, preferably has a considerably smaller diameter than the rear roller 50, with the result that it can be arranged as closely as possible to the sheet material 71. Arranged downstream of the front roller 51, as seen in the conveying direction, is a tongue-like holding-down element 6, which likewise rests on the second groups. It is preferably of resilient design. This holding-down element 6 extends into the flexible tube 72 and thus makes it possible for the second groups to be guided until they are covered by the flexible tube 72.

Figure 4:
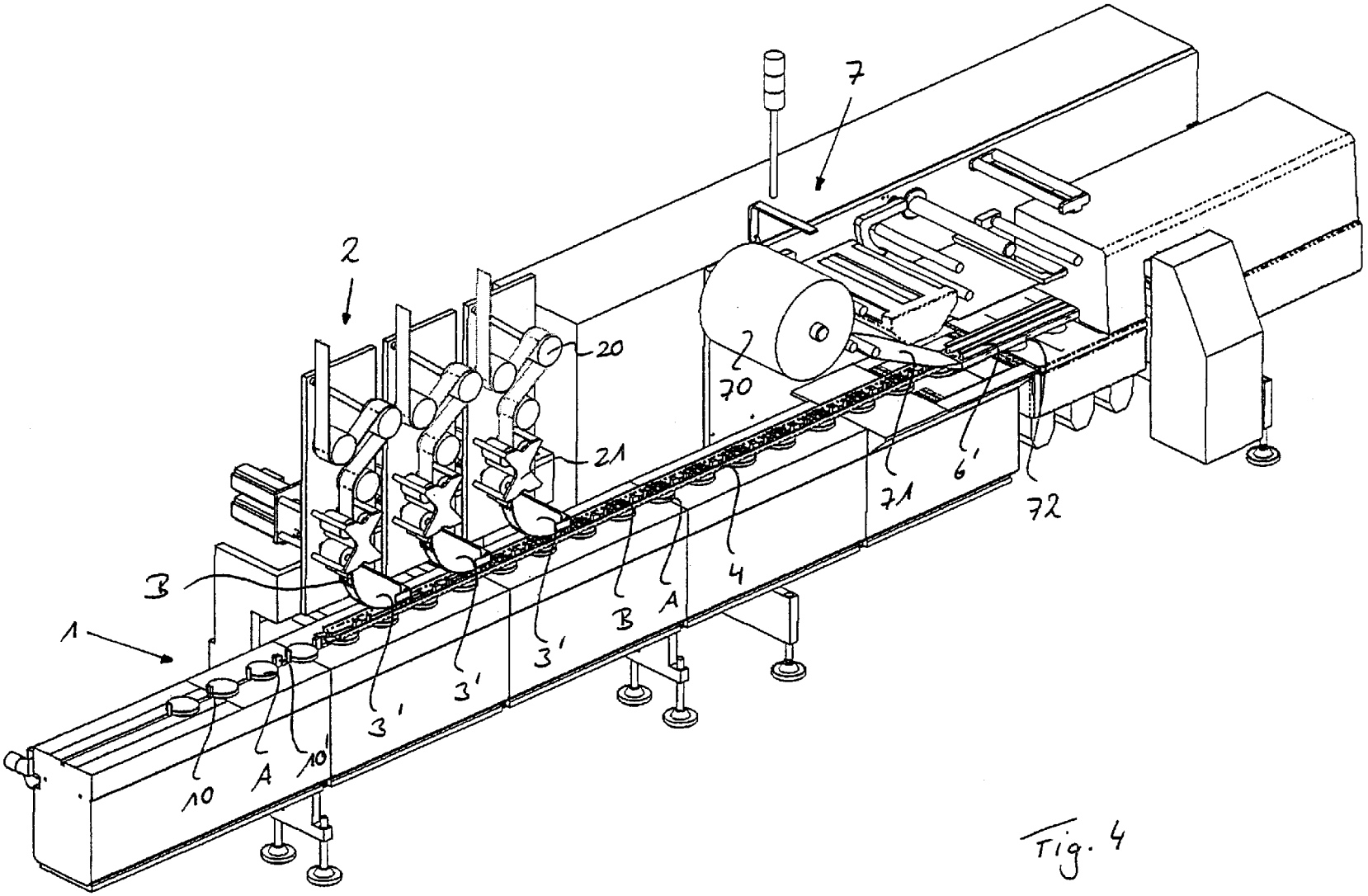
FIG. 4 shows a perspective illustration of a second embodiment of an apparatus according to the invention.
Figure 5:
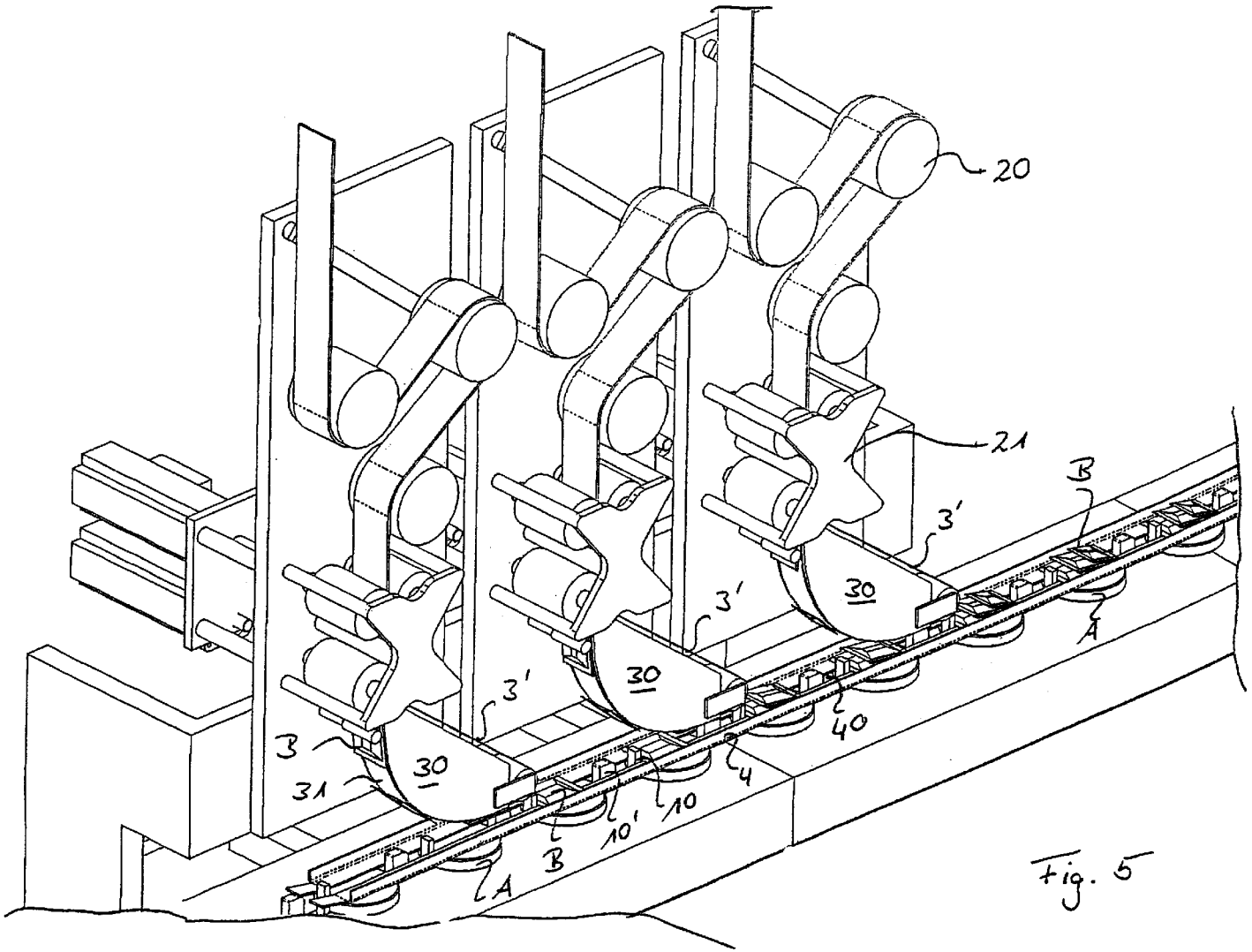
FIG. 5 shows an enlarged detail of FIG. 4, of the feed stations with the second conveyors.
Figure 6:
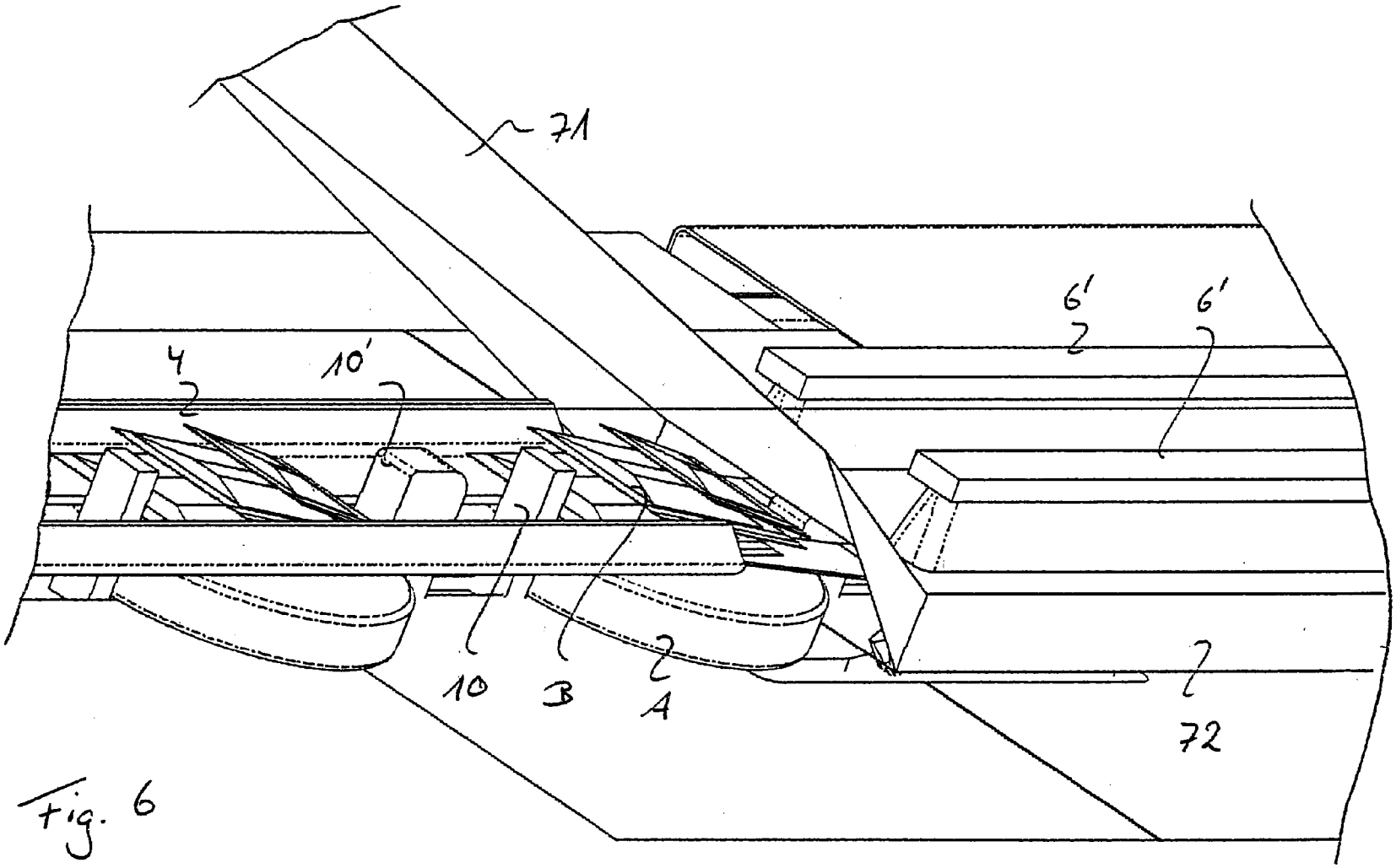
FIG. 6 shows an enlarged detail of FIG. 4 in the packaging station.

FIGS. 4 to 6 illustrate a second embodiment of the apparatus according to the invention. The same parts have the same designations and will thus not be mentioned in detail here again. In contrast to the first embodiment, each feed station 2 is assigned a second conveyor 3'. These second conveyors 3' are preferably belt conveyors which run around a supporting body 30. In this case, the supporting body 30 is of semicircular design. Every second conveyor 3' has an abutment surface 31, in this case semicircular, which is directed downward. On this abutment surface 31, the piece goods of the second type B are conveyed from the feed station 2 to the dead plate 4, where, in turn, they are deposited in a layered manner one above the other in first groups and are immediately transported by the carry-along element 10 of the first conveyor 1. The type of layered formation depends on the speed of the second conveyors 3' relative to the first conveyor 1, account being taken of the distance between the second conveyors 3'.

In order that the piece goods of the second type B are transported in a guided manner by the second conveyors 3', the abutment surface 31 is subjected to vacuum action and/or it has adhesive properties. Other variants are also possible as long as the piece goods of the second type B adhere to the abutment surfaces 31.

The packaging station 7 may be of the same configuration as in the first exemplary embodiment. In particular it is possible to use the same force-applying means. FIGS. 4 to 6, however, illustrate a different embodiment of these force-applying means, which can likewise be used in the exemplary embodiment according to FIGS. 1 to 3 instead of the belt conveyor 5 and the holding-down element 6. The essential factor is for these means to act on the flexible tube 72 from the outside. The means here are preferably designed as elongate brushes 6' which extend in the conveying direction and rest on the flexible tube 72 in the introduction region. It is preferable to provide, in addition, second carry-along elements 10', which are arranged upstream of the second groups, as seen in the conveying direction of the first conveyor 1, and serve as supports for said groups. This guarantees, in addition, that the second group maintains its shape as it moves into the flexible tube 72. These second carry-along elements 10', in the same way as the first carry-along elements 10, are lowered during introduction into the flexible tube 72.

The apparatus according to the invention makes it possible for non-stackable piece goods of different types to be transported together and packaged together in a tubular bag.

| List of designations | |
|---|---|
| A | Piece goods of a first type |
| B | Piece goods of a second type |
| 1 | First conveyor |
| 10 | Carry-along element |
| 10' | Second carry-along element |
| 2 | Feed station |
| 20 | Deflecting rollers |
| 21 | Separating means |
| 3 | Second conveyor |
| 3' | Second conveyor |
| 30 | Supporting body |
| 31 | Abutment surface |
| 4 | Dead plate |
| 40 | Slot |
| 5 | Belt conveyor |
| 50 | Rear deflecting rollers |
| 51 | Front deflecting rollers |
| 52 | Belt |
| 6 | Holding-down element |
| 6' | Brush |
| 7 | Packaging station |
| 70 | Reel |
| 71 | Sheet material |
| 72 | Flexible tube |

What is claimed is:

1. An apparatus for packaging piece goods, it being possible for at least one piece-goods article of a first type and piece goods of a second type to be introduced into a common pack, the apparatus comprising:

a first conveyor, for feeding piece goods of the first type, at least one second conveyor, for feeding piece goods of a second type, and a packing station, for forming a flexible tube, wherein the apparatus has at least one feed station, from which the piece goods of the second type, arranged such that they are located one above the other at least in part by means of the at least one second conveyor, form a first group, wherein the apparatus has conveying means in order to deposit the first group on a piece-goods article of the first type and to form a second group, and wherein the second group can be introduced into the flexible tube, force-applying means being provided in order that the second group maintains its shape as it is introduced into the flexible tube wherein the conveying means comprises a stationary surface and first carry-along elements which can be moved along this surface in the conveying direction of the first conveyor, the stationary surface being arranged above the first conveyor.

2. The apparatus as claimed in claim 1, wherein the feed station is designed for feeding a strip of bags which are attached to one another, the feed station having severing means for severing the strip into individual bags.

3. The apparatus as claimed in claim 1, wherein the packing station produces the flexible tube such that it runs horizontally in the conveying direction of the first conveyor.

4. The apparatus as claimed in claim 1, wherein the force-applying means comprises a circulating belt conveyor, with at least one belt, which is arranged above the second group and of which the belt rests on the second group.

5. The apparatus as claimed in claim 4, wherein the force-applying means has a resilient holding-down element which is arranged downstream of the belt conveyor as seen in the conveying direction, and rests on the second group.

6. The apparatus as claimed in claim 1, wherein the first carry-along elements are a part of the first conveyor and serve as first carry-along elements for the piece goods of the first type.

7. The apparatus as claimed in claim 1, wherein the force-applying means acts on the flexible tube from the outside.

8. The apparatus as claimed in claim 7, wherein the force-applying means is at least one brush resting on the flexible tube.

9. The apparatus as claimed in claim 6 or 7, wherein the first conveyor has second carry-along elements, which are arranged upstream of the second groups, as seen in the conveying direction of the first conveyor (1), and serve as supports for said groups.

10. The apparatus as claimed in claim 1, wherein precisely one second conveyor is provided, wherein the piece goods of the second type can be deposited on the second conveyor such that they form the first group, and wherein the conveying means deposit the first group on the piece-goods article of the first type from the second conveyor.

11. The apparatus as claimed in claim 10, wherein at least two feed stations are provided, in which case they are arranged one behind the other in the conveying direction of the second conveyor.

12. The apparatus as claimed in claim 10, wherein the second conveyor is designed to circulate in a horizontal plane.

13. The apparatus as claimed in claim 10, wherein the second conveyor has a conveying direction which runs at least more or less parallel to the conveying direction of the first conveyor.

14. The apparatus as claimed in claim 1, wherein the at least one feed station has a feed direction which runs at an angle, in particular perpendicularly, to a conveying plane of the first conveyor.

15. The apparatus as claimed in claim 14, wherein in each case one of the second conveyors is arranged beneath the at least one feed station, said second conveyor having a downwardly directed abutment surface for conveying the piece goods of the second type.

16. The apparatus as claimed in claim 15, wherein the abutment surface of the at least one second conveyor is subjected to vacuum action and/or has adhesive properties.

17. An apparatus for packaging piece goods, it being possible for at least one piece-goods article of a first type and piece goods of a second type to be introduced into a common pack, the apparatus comprising:

a first conveyor, for feeding piece goods of the first type, precisely one second conveyor, for feeding piece goods of a second type, and a packing station, for forming a flexible tube, wherein the apparatus has at least one feed station, from which the piece goods of the second type, arranged such that they are located one above the other at least in part by means of the at least one second conveyor, form a first group, wherein the apparatus has conveying means in order to deposit the first group on a piece-goods article of the first type and to form a second group, and wherein the second group can be introduced into the flexible tube, force-applying means being provided in order that the second group maintains its shape as it is introduced into the flexible tube, wherein the piece goods of the second type can be deposited on the second conveyor such that they form the first group, and wherein the conveying means deposit the first group on the piece-goods article of the first type from the second conveyor and wherein the second conveyor is designed to circulate in a horizontal plane.

18. An apparatus for packaging piece goods, it being possible for at least one piece-goods article of a first type and piece goods of a second type to be introduced into a common pack, the apparatus comprising:

a first conveyor, for feeding piece goods of the first type, at least one second conveyor, for feeding piece goods of a second type, and a packing station, for forming a flexible tube, wherein the apparatus has at least one feed station, from which the piece goods of the second type, arranged such that they are located one above the other at least in part by means of the at least one second conveyor, form a first group, wherein the apparatus has conveying means in order to deposit the first group on a piece-goods article of the first type and to form a second group, and wherein the second group can be introduced into the flexible tube, force-applying means being provided in order that the second group maintains its shape as it is introduced into the flexible tube, wherein the force-applying means comprises a circulating belt conveyor, with at least one belt, which is arranged above the second group and of which the belt rests on the second group, wherein the force-applying means has a resilient holding-down element which is arranged downstream of the belt conveyor as seen in the conveying direction, and rests on the second group.

* * * * *